US006012571A

United States Patent [19]

LaPierre

[11] Patent Number: 6,012,571

[45] Date of Patent: Jan. 11, 2000

[54] JEWELRY CASE TO TENSION CHAIN JEWELRY

[76] Inventor: Howard N. LaPierre, P. O. Box 42, Nuevo, Calif. 92567

[21] Appl. No.: 09/209,917

[22] Filed: Dec. 10, 1998

[51] Int. Cl.[7] ..... A45C 11/04

[52] U.S. Cl. ..... 206/6.1; 206/348; 206/493; 206/560; 206/565; 206/566; 211/85.2

[58] Field of Search ..... 206/6.1, 348, 493, 206/560, 565, 566; 211/85.2

[56] References Cited

U.S. PATENT DOCUMENTS

| | | | |
|---|---|---|---|
| 549,970 | 11/1895 | Lawrence | 206/566 X |
| 1,485,646 | 3/1924 | Traumüller et al. | 206/565 |
| 4,905,948 | 3/1990 | Indorf | 248/309.1 |
| 5,129,510 | 7/1992 | Wright | 206/6.1 |
| 5,425,444 | 6/1995 | Chapman | 206/6.1 |
| 5,680,928 | 10/1997 | Carr | 206/6.1 |

*Primary Examiner*—Bryon P. Gehman
*Attorney, Agent, or Firm*—Goldstein & Canine

[57] ABSTRACT

A jewelry carrier, for storing and transporting chain-like jewelry such as necklaces, comprising a base, a plurality of pegs arranged in peg rows extending from the base, and a plurality of hook carriers, each having two or more hooks. The hook carriers are each aligned with one of the peg rows. The hook carriers are capable of slidable movement toward and away from its corresponding peg row. The hook carriers are spring biased away from the pegs. Necklaces are initially placed around one of the pegs in one of the peg rows. The corresponding hook carrier is slid toward that peg row, and the necklace is placed around one of the hooks. The hook carrier is then released, the hook carrier slides away from the peg row, thereby tensioning the necklace between the hook and the peg.

6 Claims, 3 Drawing Sheets

JEWELRY CASE TO TENSION CHAIN JEWELRY

BACKGROUND OF THE INVENTION

The invention relates to a jewelry case. More particularly, the invention relates to a jewelry case which is particularly well suited for storing and transporting necklaces, bracelets, and other chain-like jewelry in a safe and convenient manner.

Although a great deal might be invested in one's jewelry collection, the storage and transport techniques commonly used for the same show little respect and offer little care for that which is being stored and transported. Commonly, the storage of necklaces involves simply piling several necklaces, chains, strings of pearls, and bracelets into a box. This practice often leads to tangling and damage.

Beyond the individual's jewelry collection, the need exists for efficient storage and transportation of necklaces on a commercial level. In typical jewelry stores, the jewelry is placed in a safe when the jewelry stores close. This requires that all chains, necklaces, and the like be placed in a storage case before being placed in the safe. Further, a large percentage of jewelry is sold at indoor and outdoor flea markets. This type of business requires that the jewelry be packed up quickly at the end of the day, that the jewelry is transported to the next sale location, and that the jewelry arrives in an untangled, ready to sell condition.

While these units may be suitable for the particular purpose employed, or for general use, they would not be as suitable for the purposes of the present invention as disclosed hereafter.

SUMMARY OF THE INVENTION

It is an object of the invention to produce a jewelry case which is capable of not only storing conventional trinket jewelry such as rings and the like, but of also storing chain-like jewelry such as necklaces and bracelets in a safe and convenient manner.

It is another object of the invention to transport jewelry in a manner which prevents tangling and damage to said jewelry. Accordingly, the necklaces are tensioned within the case between two spring-biased points.

It is yet another object of the invention that the proper level of tension can be imparted to each article of jewelry, to avoid damage thereto. Accordingly, the jewelry can be tensioned between a variety of points which are located at different distances, thus, different sized chain jewelry can be easily accommodated by the case.

The invention is a jewelry carrier, for storing and transporting chain-like jewelry such as necklaces, comprising a base, a plurality of pegs arranged in peg rows extending from the base, and a plurality of hook carriers, each having two or more hooks. The hook carriers are each aligned with one of the peg rows. The hook carriers are capable of slidable movement toward and away from its corresponding peg row. The hook carriers are spring biased away from the pegs. Necklaces are initially placed around one of the pegs in one of the peg rows. The corresponding hook carrier is slid toward that peg row, and the necklace is placed around one of the hooks. The hook carrier is then released, the hook carrier slides away from the peg row, thereby tensioning the necklace between the hook and the peg.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
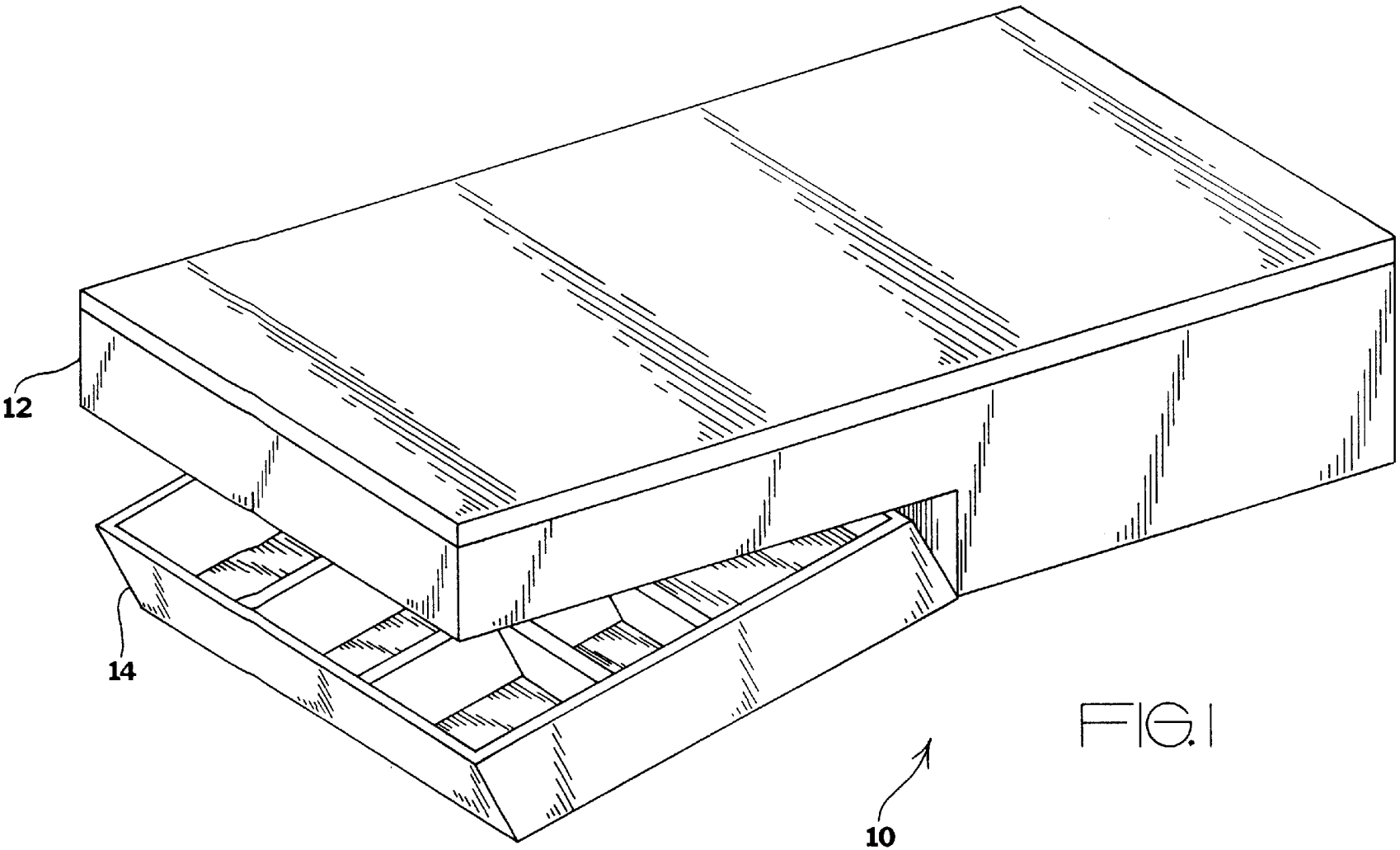
FIG. 1 is a diagrammatic perspective view, illustrating a jewelry case according to the present invention.

FIG. 1 illustrates a jewelry case 10 having a top compartment 12 and a bottom compartment 14. The bottom compartment 14 forms a typical box-like cavity which is well suited for holding assorted jewelry trinkets such as rings, broaches, and the like. The top compartment 12 however contains novel structure which is unique to the present invention.

Figure 2:
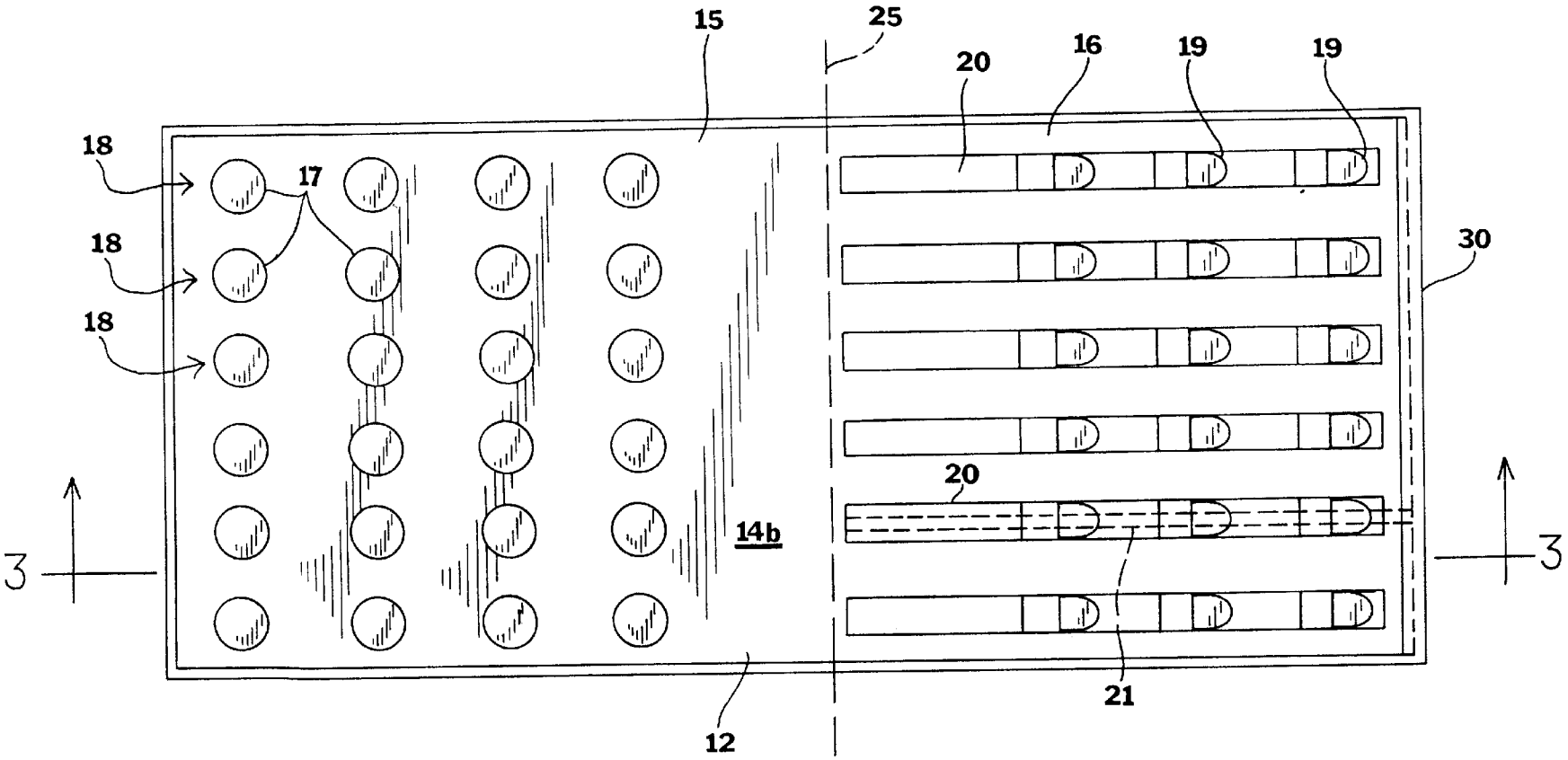
FIG. 2 is a top plan view, illustrating just the top compartment of the jewelry case.

FIG. 2 is a top plan view illustrating just the top compartment 12. The top compartment 12 has a base plane 14B. The top compartment 12 comprises a fixed portion 15 and a movable portion 16. The fixed portion 15 contains a grid of pegs 17 arranged in peg rows 18. The movable portion 16 contains a plurality of hooks 19 arranged on hook carriers 20. Each peg row 18 is aligned with one of the hook carriers 20. The top compartment 12 has a center 25 between the fixed portion 15 and movable portion 16, and comprises an outside edge 30 adjacent to the movable portion but fully opposite from the fixed portion 15. The hooks 19 and pegs 17 extend from the base 14B so that they are arranged substantially planar with each other.

Figure 3:
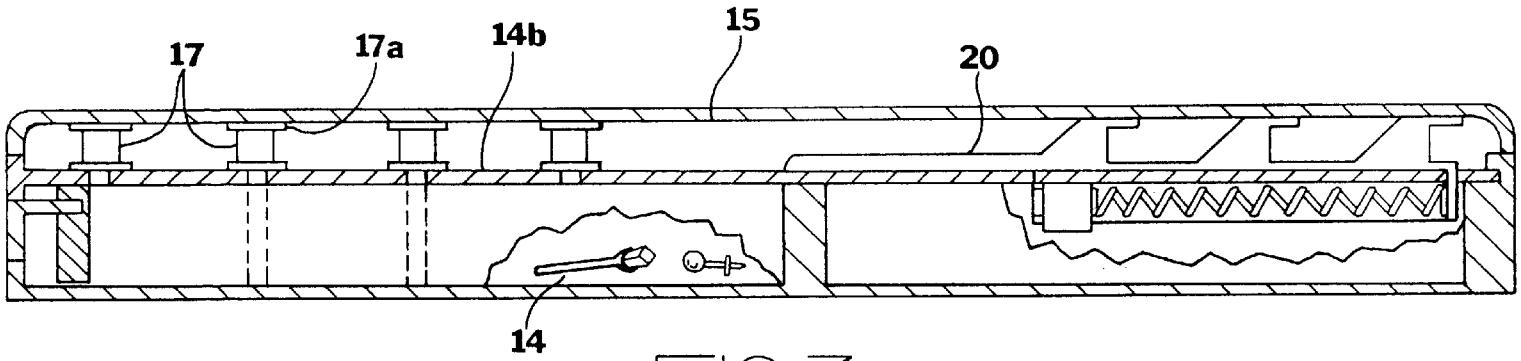
FIG. 3 is a side elevational view thereof, A portion of the case has been broken away to reveal a spring mechanism which biases one of the hook carriers toward the case outside.

Illustrated in FIG. 3, the bottom compartment 14 is located beneath the fixed portion 15, beneath the pegs 17. The pegs 17 are each spool like, having a flange 17A opposite the base plane 14B for preventing chain-like jewelry mounted thereupon from sliding off its peg 17.

Referring back to FIG. 2, each hook carrier 20 is mounted within a hook carrier groove 21 and is capable of slidable movement therein toward the center 25 and then back toward the outside edge 30.

Figure 4:
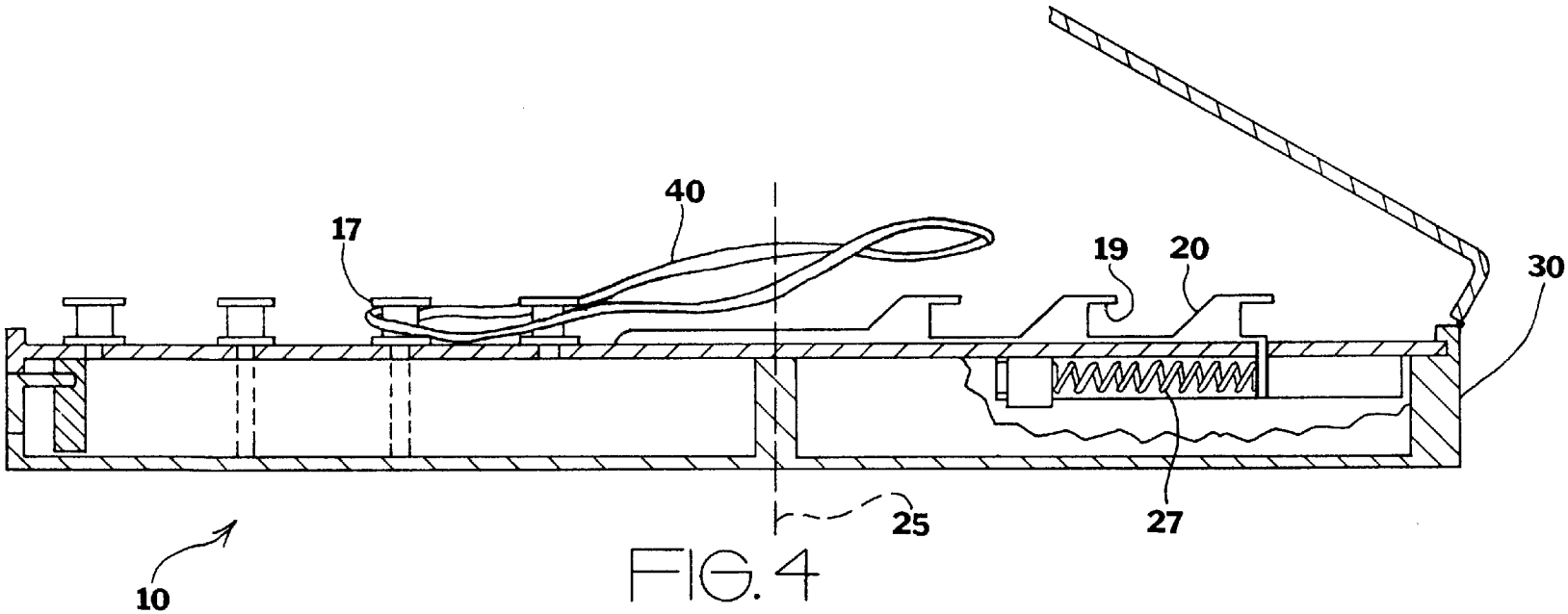
FIG. 4 is a side elevational view similar to FIG. 3, except illustrating a necklace extending over one of the pegs, and wherein one of the hook carriers being flexed inward to accept the necklace, which is being extended over one of the hooks.

FIG. 4 is a side elevational view, wherein a necklace 40 is about to be stored with the jewelry box 10. The necklace 40 has been extended around one of the pegs 17. Then, the hook carrier 20 which is aligned with the peg 17 is urged inward, toward and in fact past the center 25. Then, an end of the necklace 40 opposite the peg 17 is extended around one of the hooks 19 on the hook carrier 20. Then the hook carrier 20 is slowly released. A spring biasing mechanism 27 causes the hook carrier 20 to move outward toward the outside edge 30, exerting tension against the necklace 40. Once the hook carrier 20 has fully returned to its original position, if the necklace 40 is not tensioned, the process may be repeated, placing the necklace 40 on a different hook 19 and/or on a different peg 17 until the necklace 40 is suitably tensioned for storage.

In conclusion, herein is presented a jewelry box which has a special upper compartment for storing chain-like jewelry such as necklaces and the like. The upper compartment has an array of pegs arranged in peg rows and a plurality of hook carriers which each have at least two hooks. The hook carriers are slidably mounted for allowing a necklace to be extending between one of the pegs and one of the hooks, and then tensioned therebetween.

What is claimed is:

1. A jewelry case, for holding chain jewelry, comprising:

a base;

a fixed portion mounted to the base;

a movable portion mounted to the base, a center line extending on the base between the fixed portion and movable portion, and outer edge on the movable portion fully opposite from the fixed portion;

at least one peg row having at least two pegs on the fixed portion;

a hook carrier located on the movable portion, the hook carrier having at least two hooks which together are in line with the at least one peg row;

a hook groove in the base, the hook carrier slidably mounted in the hook groove so that the hook carrier is capable of movement toward the outer edge and toward the center line;

a spring mechanism for biasing the hook carrier toward the outer edge, the hook carrier biased toward the outer edge so that when the hook carrier is manually moved toward the center line and a piece of chain jewelry is placed around one of the hooks and one of the pegs, the hook carrier will return back toward the outer edge to tension the chain jewelry.

2. The jewelry case as recited in claim 1, wherein the pegs are arranged in a grid of peg rows, and comprising at least two hook carriers, each hook carrier aligned with one of the peg rows.

3. The jewelry case as recited in claim 2, wherein the jewelry case has a top compartment and a bottom compartment, the hook carriers and peg rows located in the top compartment, the top compartment forming a cover for the bottom compartment.

4. A jewelry storage method, for storing chain jewelry, with a jewelry box having a base, pegs extending upward from the base arranged in at least one row having at least two pegs, at least one hook carrier having at least two hooks, the at least one hook carrier in line with the at least one peg row, the at least one hook carrier capable of slidable movement away from the at least one peg row and toward the at least one peg row, comprising the steps of:

placing the chain jewelry around one of the pegs of the at least one peg row;

sliding the at least one hook carrier toward said at least one peg row;

placing said chain jewelry around one of the hooks of said at least one hook carrier; and tensioning the necklace between said peg and said hook by sliding the at least one hook carrier away from said at least one peg row.

5. The jewelry storage method as recited in claim 4, wherein the at least one hook carrier is spring biased toward the at least one peg row, and wherein the step of sliding the at least one hook carrier further comprises manually pushing the at least one hook carrier, and the step of tensioning the chain jewelry further comprises releasing the at least one hook carrier.

6. The jewelry storage method as recited in claim 5, wherein the pegs are arranged into several peg rows, and several hook carriers are present to each correspond with one of the peg rows.

* * * * *